US005501379A

United States Patent [19]

Muñoz

[11] Patent Number: 5,501,379

[45] Date of Patent: Mar. 26, 1996

[54] MODULAR UTILITY BELT

[75] Inventor: Jose C. Muñoz, Pico Rivera, Calif.

[73] Assignee: McGuire-Nicholas Company, Inc., City of Commerce, Calif.

[21] Appl. No.: 232,824

[22] Filed: Apr. 22, 1994

[51] Int. Cl.[6] ..... A45F 5/00

[52] U.S. Cl. ..... 224/240; 224/224; 224/901

[58] Field of Search ..... 224/222, 224, 224/252, 253, 904, 269, 215; 2/311, 312, 318, 319, 311; D3/215, 228, 229, 230, 226, 224, 225

[56] References Cited

U.S. PATENT DOCUMENTS

| | | | |
|---|---|---|---|
| D. 235,490 | 6/1975 | Lewis | D3/230 |
| D. 249,297 | 9/1978 | Hillinger | D3/228 |
| D. 251,758 | 5/1979 | Penrod | D3/228 |
| D. 254,758 | 4/1980 | Rodstein | D3/228 |
| D. 348,565 | 7/1994 | Cummins | 224/904 |
| D. 348,778 | 7/1994 | Dancyger | D3/228 |
| D. 348,982 | 7/1994 | Dancyger | D3/228 |
| D. 348,983 | 7/1994 | Dancyger | D3/228 |
| 882,445 | 3/1908 | Basch . | |
| 2,986,396 | 5/1961 | Abbott et al. | 2/319 |
| 3,212,690 | 10/1965 | Green | 224/904 |
| 3,664,560 | 5/1972 | Perkins | 2/312 |
| 4,408,706 | 10/1983 | Hurley | 224/904 |
| 4,676,419 | 6/1987 | Victor | 224/269 |
| 4,690,316 | 9/1987 | Peterson . | |
| 4,747,527 | 5/1988 | Trumpower, II | 224/224 |
| 4,759,483 | 7/1988 | Willoughby | 224/253 |
| 4,819,846 | 4/1989 | Hannemann . | |
| 4,828,154 | 5/1989 | Clifton, Jr. | 224/222 |
| 4,923,105 | 5/1990 | Snyder . | |
| 4,932,576 | 6/1990 | Ashley . | |
| 4,957,231 | 9/1990 | Kalisher . | |
| 4,993,614 | 2/1991 | Bonofiglo | 224/224 |
| 5,025,966 | 6/1991 | Potter . | |
| 5,081,714 | 1/1992 | Liu . | |
| 5,147,261 | 9/1992 | Smith et al. . | |
| 5,240,156 | 8/1993 | Sicotte et al. . | |

FOREIGN PATENT DOCUMENTS

| | | | |
|---|---|---|---|
| 1068240 | 12/1979 | Canada | 224/215 |

OTHER PUBLICATIONS

McGuire–Nicholas Company Catalog, Catalog No. 2004; 1993.

*Primary Examiner*—Henry J. Recla
*Assistant Examiner*—Gregory M. Vidovich

[57] ABSTRACT

A modular utility belt (10) comprises a belt (12) which can be worn around the waist of a person and at least one selectively removable belt attachment (14). The belt (12) includes a plurality of equally spaced belt apertures (30) extending therethrough. Each belt attachment (14) has a rear wall (32c) (34a) with rear apertures (40) extending therethrough, spaced about equally to the distance between two or more consecutive belt apertures (30). Selectively removable fasteners (18) extend through corresponding belt (30) and rear apertures (40) to securely hold the belt attachments (14) onto the belt (12). Additionally, outer attachments (16) can be removably attached to the belt attachment (14) with the removable fasteners (18). The belt attachments (14), (16) are interchangeable and can be easily and securely positioned at different locations on the belt (12) utilizing the removable fasteners (18).

3 Claims, 1 Drawing Sheet

MODULAR UTILITY BELT

BACKGROUND

Figures 1, 2:
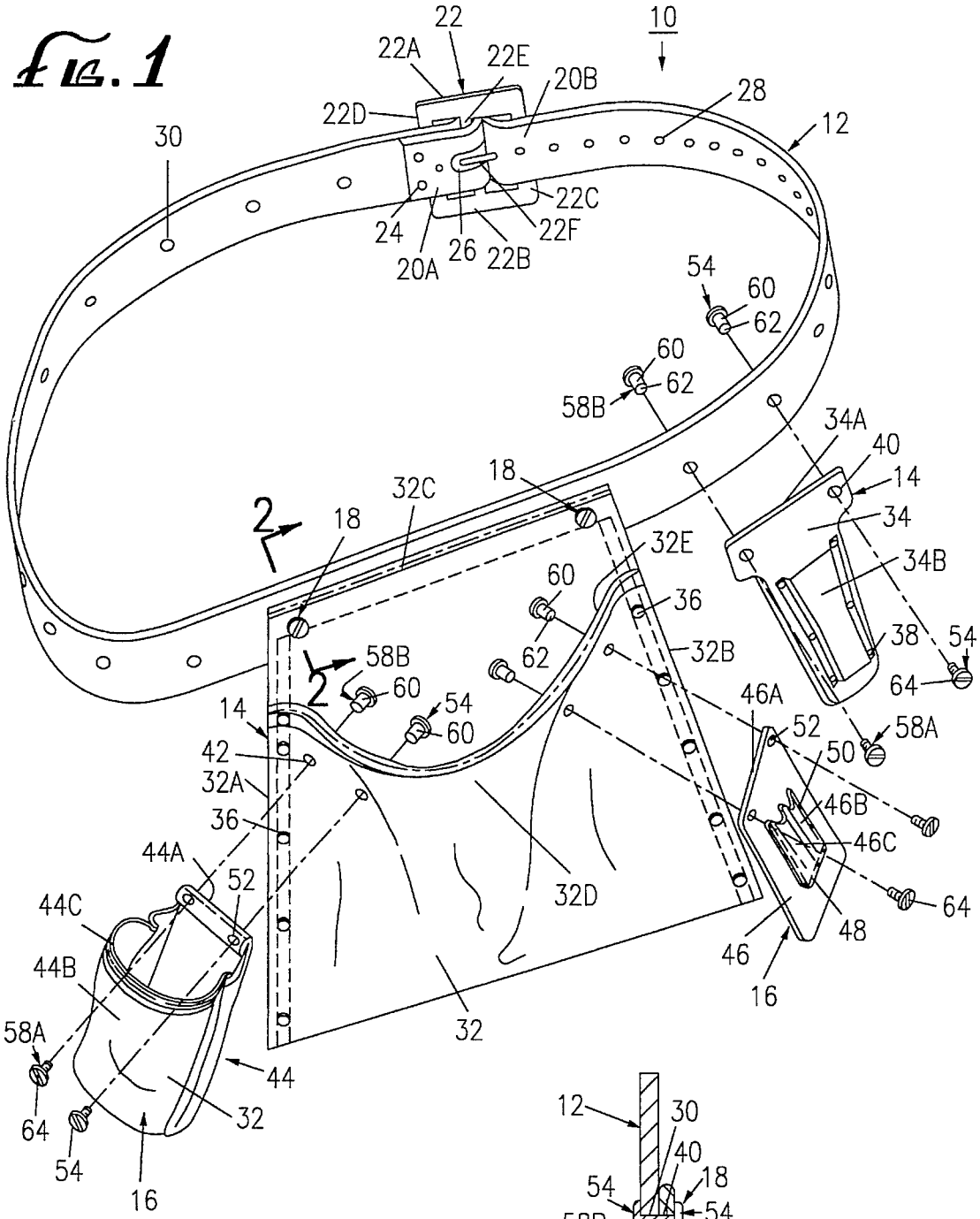

This invention is directed to a modular utility belt for a tradesperson, such as a carpenter or electrician, for conveniently carrying nails, screws, and tools.

Tool bags and/or belt-supported pouches for carrying nails, screws, bolts, and tools are well known in the industry. Typically, the tool belt is a belt worn by the tradesperson, having a number of pouches and/or tool holders fixably attached to the belt. However, since no two people and their tasks are alike, the preferred location, size, and shape of the pouches and tool holders varies according to the tradesperson and the task at hand. Thus, there is a need for a tool belt which can be easily modified to suit the individual and the task at hand.

Presently tool bags are available with removable or interchangeable pouches or tool holders. However, these tool bags have only a limited range of adjustability or the pouches and tool holders can be easily knocked off of the belt, causing the nails, screws, bolts, and/or tools to fall. This is a particular problem when the tradesperson is working at elevated levels with other people below.

Accordingly, there is a need for a tool belt which is durable and stable, and allows the tradesperson to easily pick and choose the location and type of pouches and tool holders on the tool belt to suit the tradesperson's particular needs and task requirements.

SUMMARY

The present invention is directed to a modular utility belt that meets these needs. The modular utility belt, according to the present invention, comprises (i) a belt which can be worn around the waist of a person, (ii) a belt attachment removably attached to the belt, and (iii) a pair of selectively removable fasteners. The belt can be placed around the waist of a person and has at least two belt apertures extending therethrough. The belt attachment has a rear wall with a pair of rear apertures extending through the rear wall of the belt attachment. These rear apertures are spaced substantially equal to the distance between at least two of the belt apertures. Each removable fastener is positioned in one rear aperture and one aligned belt aperture to hold the belt attachment onto the belt. As described below, these removable fasteners securely attach the belt attachment to the belt so that the belt attachment will not be easily jarred off of the belt.

Typically, the utility belt includes additional belt attachments removably attached to the belt, each belt attachment having a rear wall with a pair of rear apertures extending therethrough. For each additional belt attachment, the belt has a pair of belt apertures spaced approximately the same as the rear apertures for attaching each belt attachment to the belt with the removable fasteners. Preferably, to provide a modular design and flexibility in positioning of the belt attachments, the belt includes a plurality of equally spaced belt apertures positioned around the belt with the distance between the pair of rear apertures for each belt attachment being about equal to the distance between two or more consecutive belt apertures. For example, if the distance between consecutive belt apertures is equal to "X," the distance between the pair of rear apertures for a particular belt attachment can be "X," "2X," or "3X," etc. Thus, the belt attachments can be positioned around the belt at the location desired by the user, and the belt attachments can be interchanged to suit the task at hand.

The belt can also include outer attachments removably attached to a front wall of the belt attachments to "piggyback" additional attachments. This feature allows the tradesperson to also select and change the outer attachments. Typically, the front wall of the belt attachment has at least two front apertures extending therethrough and each outer attachment has a pair of outer apertures spaced substantially equal to the distance between at least two of the front apertures. A selectively removable fastener also extends through one outer aperture and one aligned front aperture to securely hold each outer attachment onto the belt attachment. Optimally, the distance between the outer apertures is about equal to the distance between two or more consecutive belt apertures so that the outer attachments can alternatively be attached to the belt.

The belt attachments and the outer attachments are typically (i) pouches which are useful for holding nails, bolts, screws, and (ii) tool holders which are useful for holding tools such as hammers, pliers, combination squares, drills, and tape measures.

As discussed above, each belt attachment is securely attached to the belt with removable fasteners which extend through corresponding belt apertures and rear apertures, and each outer attachment is securely attached to the belt attachment with removable fasteners which extend through corresponding front and outer apertures.

The removable fasteners preferably are male-female connectors, having opposed heads separated by a selectively detachable central portion to aid in assembly and disassembly of the belt. Optimally, the heads of the fasteners have a low profile, so that the heads extend minimally into the attachment or inside the belt to prevent interference with the use of the attachment and discomfort to the user of the belt. These male-female connectors solidly hold the attachments onto the belt while allowing the attachment to be easily removed and/or adjusted on the belt.

The present invention overcomes disadvantages of prior art utility belts since the type of attachments and the positioning of the attachments can be easily changed to suit the present and future needs and personal preferences of the tradesperson. Further, the removable fasteners solidly and securely hold the belt attachments onto the belt and the outer attachments onto the belt attachments so that these attachments are not easily jarred off the belt. Therefore, there is less danger that these attachments will fall off of the belt, causing tools and/or things in the pouch to fall.

DRAWINGS

These and other features, aspects, and advantages of the present invention will become better understood from the following description, appended claims, and accompanying drawings where:

FIG. 1 is a perspective, partially exploded assembly view of a modular utility belt having features of the present invention; and FIG. 2 is a side section view of the utility belt of FIG. 1 taken on line 2—2 in FIG. 1.

DESCRIPTION

A modular utility belt 10, according to the present invention, is sized to be worn around the waist of a person. The utility belt 10 comprises (i) a belt 12, (ii) belt attachments 14, (iii) outer attachments 16, and (iv) removable fasteners 18. The belt attachments 14 are removably attached to the belt 12 with removable fasteners 18. The outer attachments 16 are removably attached to the belt attachments 14 with removable fasteners 18.

The belt 12 is a strip of flexible material having opposed ends 20*a*, 20*b*. The belt 12 must be sufficiently long so that the belt 12 can be wrapped around the waist of a person and the opposed ends 20*a*, 20*b* attached to secure the belt 12 around the waist of the person. The design of the belt 12 varies according to the type of material utilized and the desired strength, flexibility, and comfort. For example, leather is an excellent material because of its many small fibers interwoven among and around each other. A leather belt 12 about 1¾ inches wide and about ⅛ inch thick provides a sturdy, comfortable, and durable belt 12 for carrying nails, screws, bolts, and/or tools around the waist of the person.

Typically, a belt buckle 22 is used to secure the opposed ends 20*a*, 20*b* of the belt around the waist of the person. As shown in FIG. 1, a rectangular-shaped belt buckle 22 can be used having opposed sides 22*a*, 22*b* holding a front bar 22*c*, a rear bar 22*d*, and a center bar 22*e*. A hingeable rod 22*f* rotates around the center bar 22*e* and contacts against the front bar 22*c*. One end 20*a* of the belt can be wrapped and secured with rivets 24 around the center bar 22*e* of the belt buckle. A slot 26 is cut in the belt 12 to allow the hingeable rod 22*f* to rotate. The other end 22*b* of the belt has buckle apertures 28 extending therethrough and can be inserted between the front bar 22*c* and the center bar 22*e*. The hingeable rod 22*f* is then inserted into one of the buckle apertures 28 and pulled against the front bar 22*c* to hold the belt 12 around the waist of the person. Typically, the buckle apertures 28 are spaced to provide adjustability to fit the waist of the tradesperson. As shown in FIG. 1, the buckle apertures 28 can be spaced about one inch apart.

For each belt attachment 14, the belt 12 has at least two belt apertures 30 extending therethrough for attaching each belt attachment 14 onto the belt 12. Preferably, the belt 12 has a plurality of equally spaced belt apertures 30 extending therethrough to allow for a modular design and for flexibility in positioning of the belt attachments 14. The number and spacing of the belt apertures 30 depends upon the size of the belt attachments 14 and the desired flexibility in selecting the positioning of the belt attachments 14. The size of the belt apertures 30 varies according to the size of the removable fasteners 18. Too many and too large of belt apertures 30 reduce the strength of the belt 12. In the utility belt 10 shown in the figures, the belt apertures 30 are about 3/16 of an inch in diameter and are spaced about 3¾ inches apart. These belt apertures 30 are typically centered in the middle of the belt 12.

For example, as shown in FIG. 1, the belt attachments 14 can include a large belt pouch 32 for holding nails, screws, bolts, etc., and a tool holder 34 for carrying a combination square (not shown). The belt pouch 32 is formed by folding a piece of durable material such as leather and sewing the opposed sides 32*a*, 32*b* and/or inserting rivets 36 into the opposed sides 32*a*, 32*b*. The belt pouch 32 has a rear wall 32*c*, a front wall 32*d*, and a top opening 32*e*. The sewing ensures that no nails, screws, bolts, nuts spill out of the sides 32*a*, 32*b* of the belt pouch 32, while the rivets 36 provide additional support to the belt pouch 32 to hold the belt pouch 32 together. Typically, the front wall 32*d* of the belt pouch is wider to form a pocket for holding things and allowing the tradesperson's hand to be inserted into the belt pouch 32 to retrieve the things. Further, the leather at the top opening 32 can be folded and sewn so that the top opening 32*e* does not fray and to provide additional strength to attach the pouch 32.

As shown in FIG. 1, the belt tool holder 34 can comprise a rear wall 34*a* having a U-shaped member 34*b* attached with rivets 38 onto the rear wall 34*a*, the U-shaped member being sized to receive a combination square. Alternatively, the shape and size of the tool holder 34 depends upon the desired tool to be held.

The rear wall 32*c*, 34*a* of each belt attachment 14 has a pair of attachment apertures 40 extending therethrough. The distance between each pair of attachment apertures 40 is about equal to the distance between at least two belt apertures 30. To facilitate a modular design, if the belt 12 has a plurality of equally spaced belt apertures 30, the spacing between the attachment apertures 40 should be about equal to the space between two or more consecutive belt apertures 30. For example, if the belt apertures 30 are spaced about 3¾ inches apart, the attachment apertures 40 for each belt attachment 14 can be spaced about 3¾ inches apart, 7½ inches apart, or 11¼ inches apart. Thus, the belt attachments 14 can be interchanged or attached at different locations along the belt 12 to suit the needs and preferences of the tradesperson. Further, the size of the attachment apertures 40 should correspond to the size of the belt apertures 30, namely, in the utility belt 10 shown in the figures, about 3/16 inch in diameter.

Additionally, the front wall 32*d* of each belt attachment 14 can include at least two front apertures 42 extending therethrough for removably attaching outer attachments 16. The spacing of the front apertures 42 depends upon the size of the outer attachments 16 and the belt attachments 14. Preferably, to provide a modular design, the front apertures 42 are sized similarly to the belt apertures 30, namely about 3/16 of an inch in diameter, and are spaced similarly to the belt apertures 30, about 3¾ inches, 7½ inches, or 11¼ inches apart depending upon the size of the belt attachment 14 and the outer attachments 16, so that the outer attachments 16 can alternatively be attached to the belt 12.

As discussed above, the outer attachments 16 are removably attached to the front wall 32*d* of the belt pouch 32. Each outer attachment 16 can be a pouch for holding nails, screws, bolts, or a tool holder for holding a hammer, drill, straight edge, tape measure, and/or other tools. As shown in FIG. 1, the outer attachments 16 is an outer pouch 44 constructed similarly to the belt pouch 32 and an outer tool holder 46. The outer pouch 44 has a rear wall 44*a*, a front wall 44*b*, and a top opening 44*c*. The outer tool holder 46 is a marker/pencil/chalk holder and comprises a rear wall 46*a* having two closely spaced loops 46*b*, 46*c* for holding a maker/pencil/chalk (not shown). The loops 46*b*, 46*c* are sewn 48 and riveted 50 onto the rear wall 46*a*.

The rear wall 44*a* and 46*a* of the outer attachments 16 has outer apertures 52 extending therethrough. Preferably, the outer apertures 52 are sized equally to the front apertures 42, namely 3/16 of an inch in diameter, and are spaced equally to at least two consecutive front apertures 42, in this case, being about 3¾ inches apart. Preferably, to provide a modular design, the outer apertures 52 are also sized similarly to the belt apertures 30, namely about 3/16 of an inch in diameter, and are spaced similarly to the belt apertures 30, about 3¾ inches, 7½ inches, or 11¼ inches apart depending upon the size of the outer attachment 16 and belt attachment 14, so that the outer attachments 16 can alternatively be attached to the belt 12.

Each selectively removable fastener 18 has opposed heads 54 attached by a central section 56. The central section 56 extends through corresponding belt 30 and attachment apertures 40, so that the opposing heads 54 can securely hold the belt attachment 14 onto the belt 12. Further, for each outer attachment 16, the central section 56 extends through corresponding front 42 and outer apertures 52 so that the opposing heads 54 can securely hold the outer attachment 16 onto the belt attachment 14.

The removable fasteners 18 can be a bolt (not shown) extending through the apertures with a corresponding nut (not shown) for holding the belt attachments 14 onto the belt 12 or the outer attachment 16 onto the belt attachment 14 or another type of conventional fastener. Preferably, however, the removable fasteners 18 are male-female connectors 58*a*, 58*b* having low profile heads so that the heads 54 do not protrude a large distance into the attachments 14, 16 or into the belt 12. Additionally, the opposed heads 54 can include a slot 64 for a screwdriver for securing or loosening the male-female connector 58*a*, 58*b*. As shown in the Figures, the female connector 58*b* can be pin-shaped, having a flat to slightly rounded head and a central rod 60 having internal female threads 62. The male connector 58*a* can be shaped similar to a button-head bolt and sized to thread into the internal female threads 62. The opposed heads 54 must be larger than the apertures to hold the attachments onto the belt 12. In the embodiment shown in the drawings, the diameter of the opposed heads 54 is about ⅜ of an inch.

For the belt attachments 14, the length of the central section 56 is slightly less than the combined thickness of the belt 12 and rear wall of the attachment 14. Similarly, for the outer attachments 16, the length of the central section 56 is slightly less than the combined thickness of the front wall 32*d* of the belt pouch 32 and rear wall 44*a* of the outer aperture 16. In the embodiment shown in the figures, the length of the central section 56 is about one-quarter of an inch.

Typically, the size and shape of the central section 56 of the removable fastener 18 is slightly less than the size and shape of the apertures so that each fastener 18 can be easily inserted through the apertures and to allow for slight misalignment of the apertures. However, it is important that the size and shape of the central section 56 be close to that of the apertures to provide a secure and snug fit of the belt attachments 14 to the belt 12 and the outer attachments 16 to the belt attachments 14. For the utility belt 12 shown in FIG. 1, the diameter of the central section 56 is about 3/16 of an inch in diameter. Preferably, the central section 56 is smooth to reduce wear in the apertures and to allow for easy insertion and removal.

Typically, the removable fasteners 18 are made of a durable material such as steel. Preferably, the steel is nickel plated to provide corrosion resistance.

The modular utility belt 10, according to the present invention, combines the security and durability of conventional utility belts 10, with the ability to quickly and easily custom design and modify the location and type of belt attachments 14 and outer attachments 16 on the belt 12.

Although the present invention has been described in considerable detail with reference to certain preferred versions, many other versions should be apparent to those skilled in the art. For example, other attachments (not shown) could be removably attached to the front wall 44*b* of the outer attachment 16. Also, instead of a belt buckle 22, hook and loop fasteners, such as Velcro brand fasteners, can be used to hold the opposed ends 20*a*, 20*b* of the belt around the waist of the person. Therefore, the spirit and scope of the appended claims should not necessarily be limited to the description of the preferred versions contained herein.

I claim:

1. A utility belt comprising:

(a) a belt adapted to be worn about the waist of a user, the belt having at least five equally spaced belt fastener receivers positioned around the belt and extending therethrough, the distance between adjacent belt fastener receivers being equal to X;

(b) a belt attachment comprising a rear wall having a pair of belt fasteners spaced apart a distance substantially equal to X multiplied by an integer which is at least two, wherein said pair of belt fasteners correspond with and mate with a first pair of said belt fastener receivers to selectively attach the belt attachment to the belt with at least one belt fastener receiver between said first pair of belt fasteners without a belt fastener engaged thereto and a front wall attached to said rear wall having a pair of outer fastener receivers wherein the distance between the pair of outer fastener receivers is substantially equal to an integer multiple of X; and (c) an outer attachment comprising a rear wall having a pair of outer fasteners spaced apart a distance substantially equal to an integer multiple of X, said pair of outer fasteners corresponding with and mating with one of a second pair of said belt fastener receivers, respectively, and said pair of outer fastener receivers, respectively, for selectively attaching the outer attachment to one of said belt and said front wall of said belt attachment.

2. The utility belt of claim 1, wherein the outer fastener receivers are apertures which extend through the front wall of the belt attachment and each outer fastener comprises a male connector having an externally threaded surface and a female connector having an internally threaded surface which corresponds with and mates with the externally threaded surface.

3. A utility belt comprising:

(a) a belt adapted to be worn about the waist of a user, the belt having at least four equally spaced belt apertures extending therethrough, the distance between adjacent belt apertures being equal to X;

(b) a belt attachment comprising a rear wall having a pair of spaced rear apertures extending therethrough wherein the distance between the rear apertures being substantially equivalent to the distance between two of the belt apertures and a front wall attached to said rear wall having at least two front apertures extending therethrough wherein the distance between adjacent front apertures being substantially equal to X;

(c) a pair of belt fasteners extending through the rear apertures, respectively, and a first pair of belt apertures, respectively, for selectively attaching the belt attachment to the belt, said first pair of belt apertures being spaced substantially equal to the distance between the pair of rear apertures, each of said belt fasteners comprising a male connector having an externally threaded surface and a female connector having an internally threaded surface which corresponds with and mates with the externally threaded surface for selectively attaching said belt attachment to said belt;

(d) an outer attachment comprising a rear wall having a pair of outer apertures extending therethrough, the outer apertures being spaced apart a distance substantially equal to the distance between two of the front apertures wherein the distance between adjacent front apertures being substantially equal to X; and (e) a pair of outer fasteners for selectively attaching the outer attachment to one of said belt and said front wall of said belt attachment, each outer fastener comprising a male connector having an externally threaded surface and a female connector having an internally threaded surface which corresponds with and mates with the externally threaded surface for selectively attaching said outer attachment to one of said belt and said front wall of said belt attachment, said outer fasteners extending through said pair of outer apertures, respectively, and one of a pair of said belt apertures, respectively, and a pair of said front apertures, respectively.

* * * * *